US006945328B2

(12) United States Patent
Cruickshank et al.

(10) Patent No.: US 6,945,328 B2
(45) Date of Patent: Sep. 20, 2005

(54) LOCKABLE MOTOR ASSEMBLY FOR USE IN A WELL BORE

(75) Inventors: Brian Cruickshank, The Woodlands, TX (US); John P. Boyce, Aigburth (GB); Christopher J. Caton, Pitmedden (GB); Bruce McGarain, Stonehaven (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/694,069

(22) Filed: Oct. 27, 2003

(65) Prior Publication Data

US 2004/0089478 A1 May 13, 2004

Related U.S. Application Data

(63) Continuation of application No. 10/031,456, filed as application No. PCT/GB00/02843 on Jul. 24, 2000, now Pat. No. 6,659,203.

(30) Foreign Application Priority Data

Jul. 22, 1999 (GB) ..... 9917267

(51) Int. Cl.[7] ..... E21B 29/06
(52) U.S. Cl. ..... 166/298; 166/117.6; 175/82
(58) Field of Search ..... 166/50, 55, 117.5, 166/117.6, 297, 298, 313, 386, 387; 175/82, 107, 106, 92

(56) References Cited

U.S. PATENT DOCUMENTS

| | | | | | |
|---|---|---|---|---|---|
| 3,896,667 | A | * | 7/1975 | Jeter | 73/152.46 |
| 4,427,079 | A | | 1/1984 | Walter | |
| 4,705,117 | A | | 11/1987 | Warren et al. | |
| 5,154,231 | A | * | 10/1992 | Bailey et al. | 166/298 |
| 5,443,129 | A | * | 8/1995 | Bailey et al. | 175/45 |
| 5,787,978 | A | * | 8/1998 | Carter et al. | 166/117.6 |
| 5,826,651 | A | * | 10/1998 | Lee et al. | 166/117.6 |
| 5,911,275 | A | | 6/1999 | McGarian et al. | |
| 5,947,201 | A | * | 9/1999 | Ross et al. | 166/298 |
| 6,454,007 | B1 | * | 9/2002 | Bailey | 166/298 |

FOREIGN PATENT DOCUMENTS

FR 2332412 6/1977

* cited by examiner

*Primary Examiner*—David Bagnell
*Assistant Examiner*—Daniel P Stephenson
(74) *Attorney, Agent, or Firm*—Conley Rose, P.C.

(57) ABSTRACT

A lockable motor assembly for use in a well bore comprises a PDM motor having a rotor and a stator. A locking member has a splined projection which is received within a splined recess of the rotor and external splines which mate with splines provided on a sub connected to the stator. The components are held in this configuration by a shear ring until the fluid pressure within a chamber defined between the locking member and the sub is sufficient to cause the shear ring to shear. The locking member may then move out of the engagement with the rotor to free the motor for operation. The locking member is held in this position by a ratchet mechanism.

24 Claims, 4 Drawing Sheets

1
2
3
4
5
6
7
8
12
13
14
15
17
18
19
23
24
25
26
27
28
29
30
31
35
A
B

LOCKABLE MOTOR ASSEMBLY FOR USE IN A WELL BORE

CROSS-REFERENCE TO RELATED APPLICATIONS

This is a continuation application of U.S. patent application Ser. No. 10/031,456, filed Apr. 30, 2002 now U.S. Pat. No. 6,659,203, hereby incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to a lockable motor assembly for use in a well bore.

BACKGROUND OF THE INVENTION

The use of a downhole motor to drive a rotating tool, for example a milling tool, in a downhole assembly has well recognized advantages. Downhole motors available heretofore have, however, suffered from the disadvantage that the rotor of the motor cannot be locked to the stator of the motor. As a result, relative rotation of the elements of a tool assembly above and below the motor is possible. This renders impossible or at least complicates the accurate angular orientation of the components located below the motor.

If the components below the motor include a hydraulically settable packer or anchor, the fluid displacement required to set the packer or anchor is liable to drive the motor during the setting procedure, further complicating accurate angular orientation of the tool.

In certain applications, for example the drilling of a lateral well bore from a main well bore using a whipstock to deflect a milling tool, accurate angular orientation of certain components (the whipstock in this case) is critical.

A prior art lockable motor assembly is disclosed in FR-A-2,332,412. This prior art motor assembly comprises a locking member which is initially fixed, by means of a shear pin, relative to a motor stator at a location axially spaced from the motor rotor. The arrangement is such that the rotor may freely rotate relative to the stator. In the event that the rotor is to be locked relative to the stator, a drop ball is released into the motor assembly and received on a shoulder within a bore of the locking member. The position of the drop ball within the bore of the locking member allows a fluid flow within the motor assembly to apply sufficient force on the locking member to shear the shear pin and move the locking member into engagement with the rotor. The rotor is thereby rotationally fixed relative to the stator. The prior art motor assembly does not comprise means for returning the locking member to a position where the rotor is free to rotate relative to the stator.

A further prior art motor assembly is disclosed in U.S. Pat. No. 4,705,117. This prior art motor also comprises a rotor lockable relative to a stator by means of a locking member. During use of the prior art motor, the locking member is initially located so as to prevent rotation of the rotor relative to the stator. The locking member is rotationally fixed relative to the stator and secured to the rotor by means of a plurality of shear pins. In the event that the rotor is to be rotated relative to the stator, a drop ball is released into the motor assembly and received by the locking member. As a consequence, passageways defined in the locking member are closed by the drop ball allowing a fluid flow within the motor assembly to apply sufficient force on the locking member to shear the plurality of shear pins and move the locking member into a position whereby both the rotor and the locking member may rotate relative to the stator.

SUMMARY OF THE INVENTION

In accordance with the present invention a lockable motor assembly for use in a well bore comprises: the stator; a rotor rotatably mounted in the stator; a locking member movable axially of the motor between a first position in which the locking member is rotationally fast with the stator and is in engagement with the rotor to prevent rotation of the rotor relative to the stator, and a second position in which one of the stator and the rotor is free to rotate relative to the locking member to permit relative rotation between the stator and the rotor; and holding means for holding the locking member in the first position and selectively releasable to permit the locking member to move to the second position; and pressure sensitive means for moving the locking member between the first and second positions; characterized in that the pressure sensitive means comprises a differential area piston provided by the locking member whereby fluid acting on one portion of the piston is sealed from fluid acting on another of the piston.

Preferably, the locking member when in its first position is rotationally fast with the rotor and when in its second position is spaced from the rotor to permit rotation of the rotor relative to the locking member and the stator. If the motor is of the type in which the rotor, in use, rotates about a fixed axis (if for example it is of the vane type, the turbine type or the positive displacement type), the locking member preferably has a non-circular profile which, when the locking member is in the first position engages a complementary non-circular profile provided on the rotor. The non-circular profile on the locking member preferably takes the form of a projection which, when the locking member is in the first position, engages a complementary recess provided in the rotor. The non-circular profile is preferably provided by a plurality of splines.

If the motor is of the PDM type, the rotator will, in use, rotate about an axis which itself precesses around a circular path. Under these circumstances it is not strictly necessary for the locking member and the rotor to have complimentary inter-engaging non-circular profiles. As long as the locking member prevents precessional movement of the rotor axis the rotator will be locked against rotation. The locking member and the rotor may accordingly have mating circular profiles, or engage each oilier in some other way. However, even if the motor is of the PDM type the rotor may be locked by use of mating non-circular profiles on the locking member and the rotor.

Preferably, means sensitive to hydraulic pressure within the motor assembly are provided for releasing the holding means when the pressure within the motor assembly reaches a predetermined value. Preferably, the pressure sensitive means comprises a differential area piston provided by the locking member.

Preferably the holding means comprises one or more shear elements, for example one or more shear pins or a shear ring.

Preferably, means are provided for maintaining the locking member in the second position after it has been shifted from the first position to the second position.

Preferably, the locking member includes a through passage which provides fluid communication from the proximal end of the motor assembly to the input to the motor.

Preferably, if the motor is of the PDM type the rotor thereof will include a through passage which, when the locking member is in its first position, communicates with the through passage in the locking member to provide a fluid passage from the proximal end of the motor assembly to the distal end thereof. This fluid passage may conveniently be used to communicate fluid pressure to a packer, an anchor or other tool which is connected to the motor assembly and located below the motor assembly. If the motor is of a type (for example a vane type) which permits some flow through the motor even when the rotor is locked, the provision of a through passage in the rotor may not be necessary to set a packer or anchor, but none the less may be desirable since it will allow fluid to be pumped through the motor to perform auxiliary function below the motor, e.g. bit cooling or cuttings removal.

If a packer or anchor is connected to the motor, the shear means may be designed to shear at a pressure higher than the setting pressure of the packer or anchor so that a complete assembly which includes the motor assembly and the packer/anchor may be run into a well bore, rotationally oriented, the packer/anchor set, and the shear means sheared to release the motor for rotation, all in a single trip. Preferably, a whipstock and a mill will be located between the motor and the packer/anchor so that after the packer/anchor has been set and the locking member has been moved to the second position to release the rotor, the motor can be operated to rotate the mill and form a window in the well casing.

Preferably, the motor is a PDM motor with directional drilling ability.

The preferred embodiment of the invention permits an assembly of one or more packers and/or anchors, a whipstock, one or more mills and/or bits, and a locked PDM motor to be run in to a well bore in a single trip. The assembly can be rotated to orient the whipstock correctly using appropriate orientation techniques. The pressure in the tubing string may then be increased to sequentially set the packer/anchor(s) and move the locking member to its second position thereby releasing the PDM motor rotor for rotation. The mill can then be sheared from the whipstock and mud flow increased to activate the motor and commence milling. Accordingly, a PDM powered whipstock milling assembly may be run in to a well, oriented, set, and activated to mill a window in a casing in a single trip. If the lead mill is of an appropriate type, for example a PDC bit designed to drill formation, the assembly may be used to drill to the required depth after it has broken through the casing. Accordingly all the steps necessary to drill a lateral may be completed in a single trip.

BRIEF DESCRIPTION OF THE DRAWINGS

The above and further features and advantages of the invention will become clear from the following description of a preferred embodiment thereof, given by way of example only, reference being had to the accompanying drawings wherein.

DETAILED DESCRIPTION

Figures 1, 2, 3:
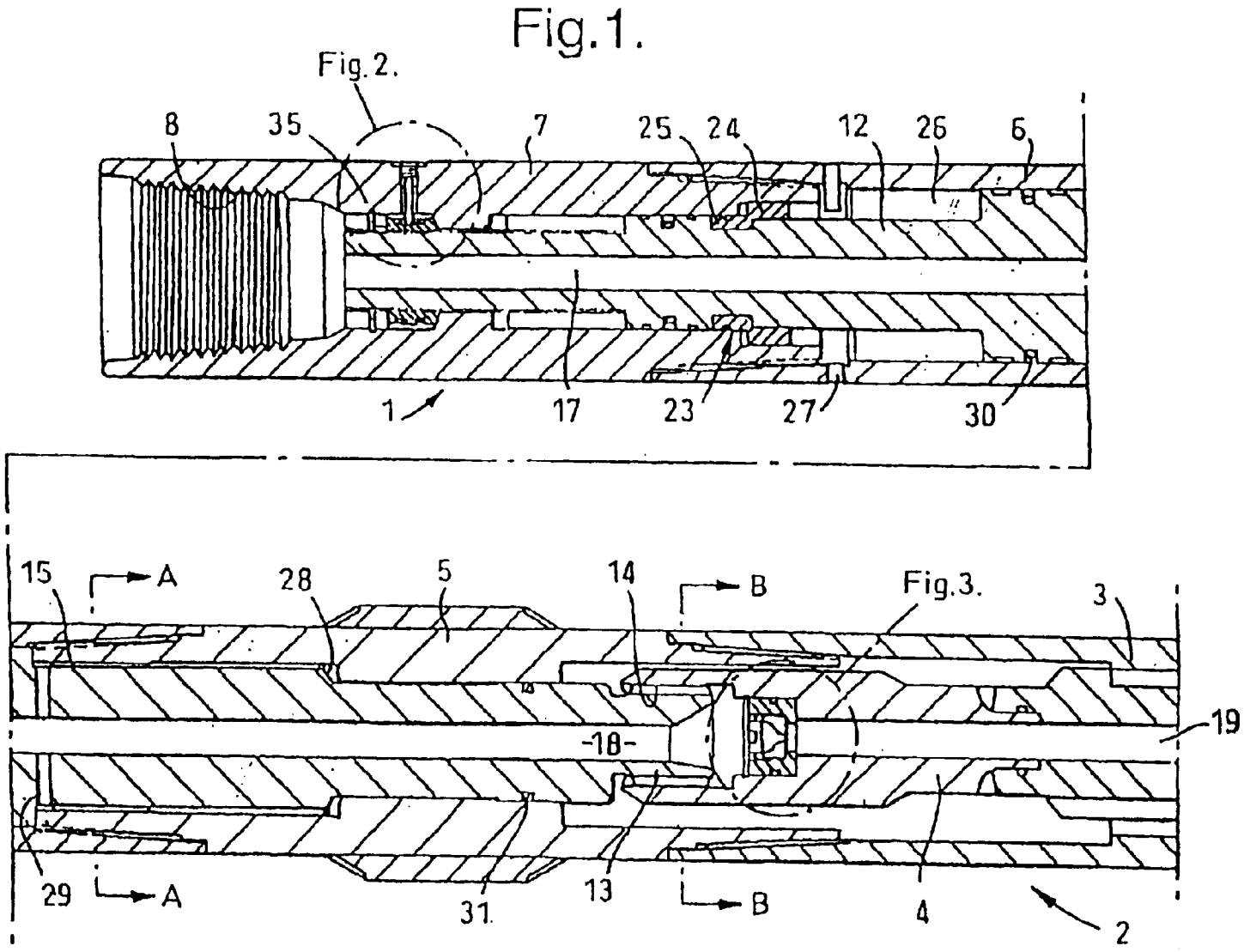
FIG. 1 illustrates schematically in longitudinal cross-section the upper portion of a lockable motor assembly in accordance with a preferred embodiment of the invention, the locking member being in its first position locking the rotor of the motor against rotation.
FIGS. 2 are 3 and detailed views of portions of FIG. 1.
Figure 2:
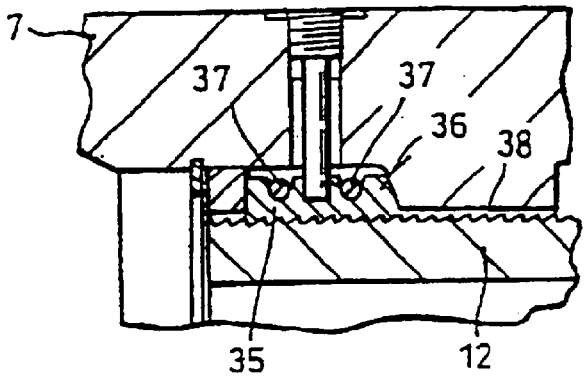
Figure 3:
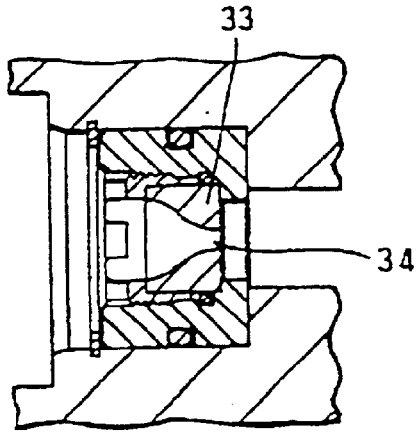
Figure 4:
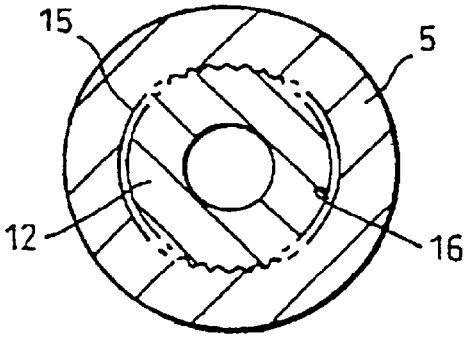
FIGS. 4 and 5 are cross-sections respectively on the lines A—A and B—B of FIG. 1.
Figure 5:
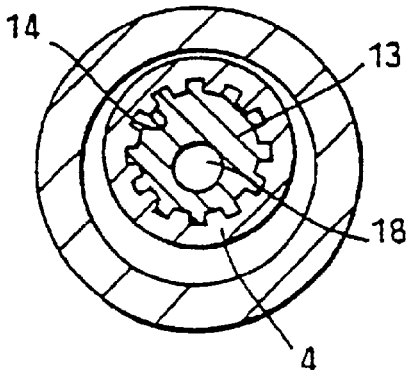

Referring firstly to FIGS. 1–5 the illustrated lockable motor assembly 1 comprises a motor 2 having a stator 3 and a rotor 4. The stator 3 is connected by an assembly of subs 5, 6, 7 to a conventional API box connector 8 by which the motor assembly may be connected to a drill string or coil tubing. The rotor 4 is mounted within the stator 3 by suitable bearings, including bearings 9 and has, at its lower end, a further box connection 10.

The motor may have sealed bearings or normally open bearings. If it is of the normally open bearing type it may be desirable to provide temporary sealing of the bearings during the packer/anchor setting procedure. The temporary bearing seals may, for example, be O-ring seals which are rapidly destroyed upon rotation of the rotor relative to the stator.

In the illustrated assembly a milling bit 11 is a PDC bit capable of drilling formation as well as milling through well casing. The bit 11 is connected to the rotor box 10 by one or more tubing lengths (not shown).

The motor is a PDM motor and is powered by means of drilling mud supplied to the assembly by the drill string or coil tubing.

As run into the well the rotor 4 of the motor is locked to the stator 3 by the means of a locking member 12. The locking members include an externally splined projection 13 which mates with an internally splined recess 14 provided in the end of the rotor. The locking member is provided with further external splines 15 which engage with mating splines 16 in a stabilizer sub 5 which is itself connected to the motor stator 3. Accordingly, when the locking member is in its first position, as illustrated in FIG. 1, the motor rotor 4 cannot rotate relative to the motor stator 3.

The use of a stabilizer sub 5 is particularly desirable where the complete assembly will be used for directional drilling. However, there may be applications of the invention where a stabilizer sub is not required and accordingly a slick may under these circumstances be used rather than a stabilizer sub.

The locking member includes a longitudinal through passage 17 which extends along the entire length thereof and, at its lower (distal) end 18, communicates with a longitudinal through passage 19 extending through the rotor. Accordingly, a fluid passage is established through the tool from the top box 8 to the bottom box 10. This fluid passage may be used to communicate fluid pressure to a device located below the motor, for example a packer or anchor located at the bottom of a whipstock 20. For this purpose, a passage is provided through the tubing lengths which connect the rotor 4 to the milling tool 11 and a flexible connecting hose 21 is connected to an appropriate nipple 22 provided on the milling tool. Thus, when the assembly is being run in to a well fluid pressure may be applied to set a packer below the whipstock via the hose 21.

It will be noted that the joint between the projection 13 and the recess 14 is not hydraulically sealed. Accordingly, fluid pressure within the passages 17 and 19 will be communicated to the power fluid inlet of the motor, thereby ensuring hydraulic pressure balance above and below the stator.

As run in to the well, the locking member 12 is maintained in its first position by a shear ring 23 which includes a first part 24 and a second part 25 connected by a relatively thin web. The ring is located such that an upward force on the locking member will bring the first part 24 of the shear ring into engagement with the shoulder provided on the sub 7 and will bring the second part 25 of the shear ring into engagement with the shoulder provided on the locking member 12. The web between the first and second parts of the shear ring is frangible and will shear when a predetermined force is applied to the locking member relative to the sub.

The function of the shear ring 23 is to hold the locking member in its first position until it is desired to release the motor for rotation. This holding function may be performed by means other than the shear ring 23. It may, for example, be performed by one or more shear pins or by some other holding element capable of holding the locking member in its first position until the locking member is selectively released and moved to its second position.

Figure 6:
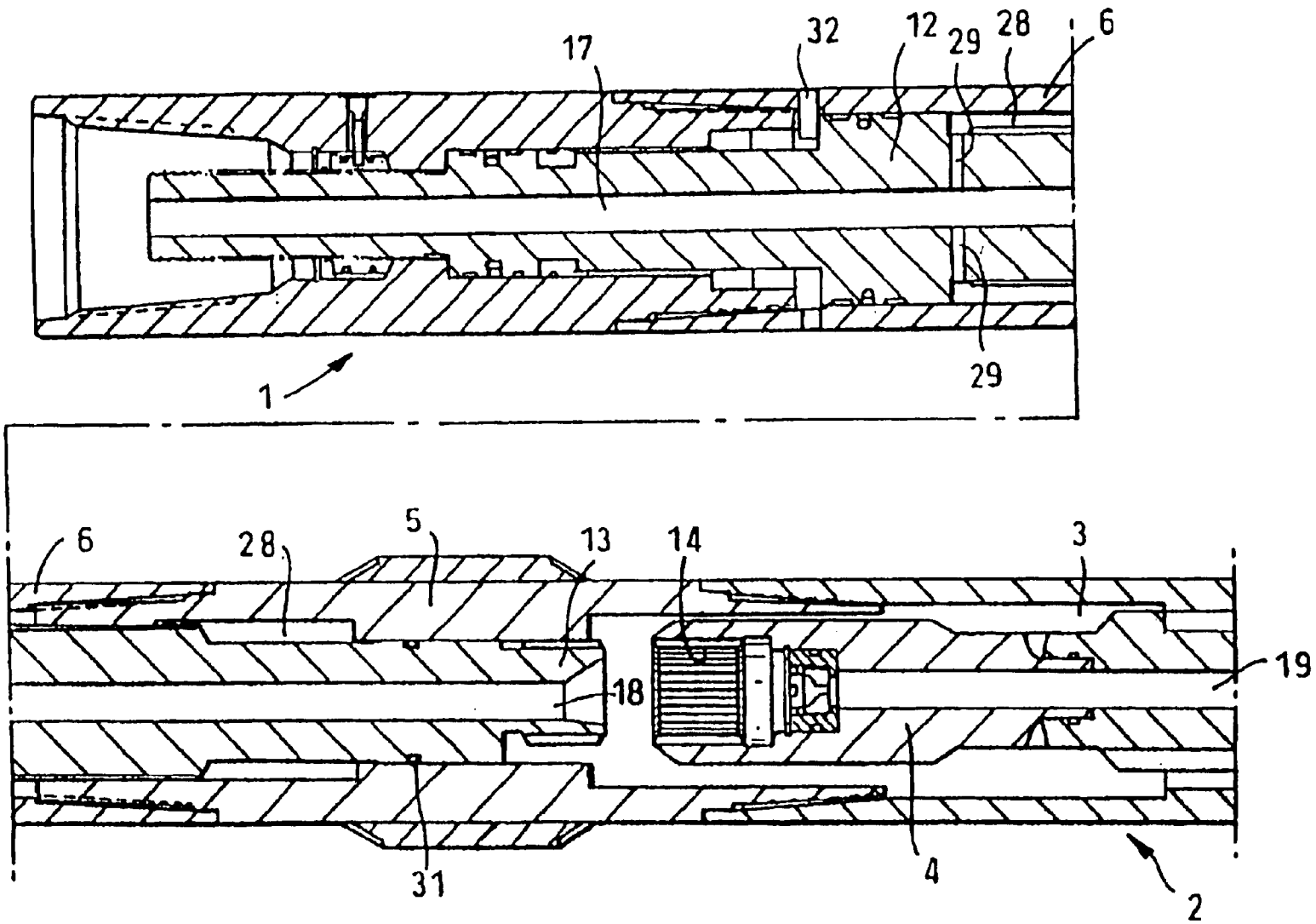
FIG. 6 is a view corresponding to FIG. 1 but showing the locking member in its second position.
Figure 7:
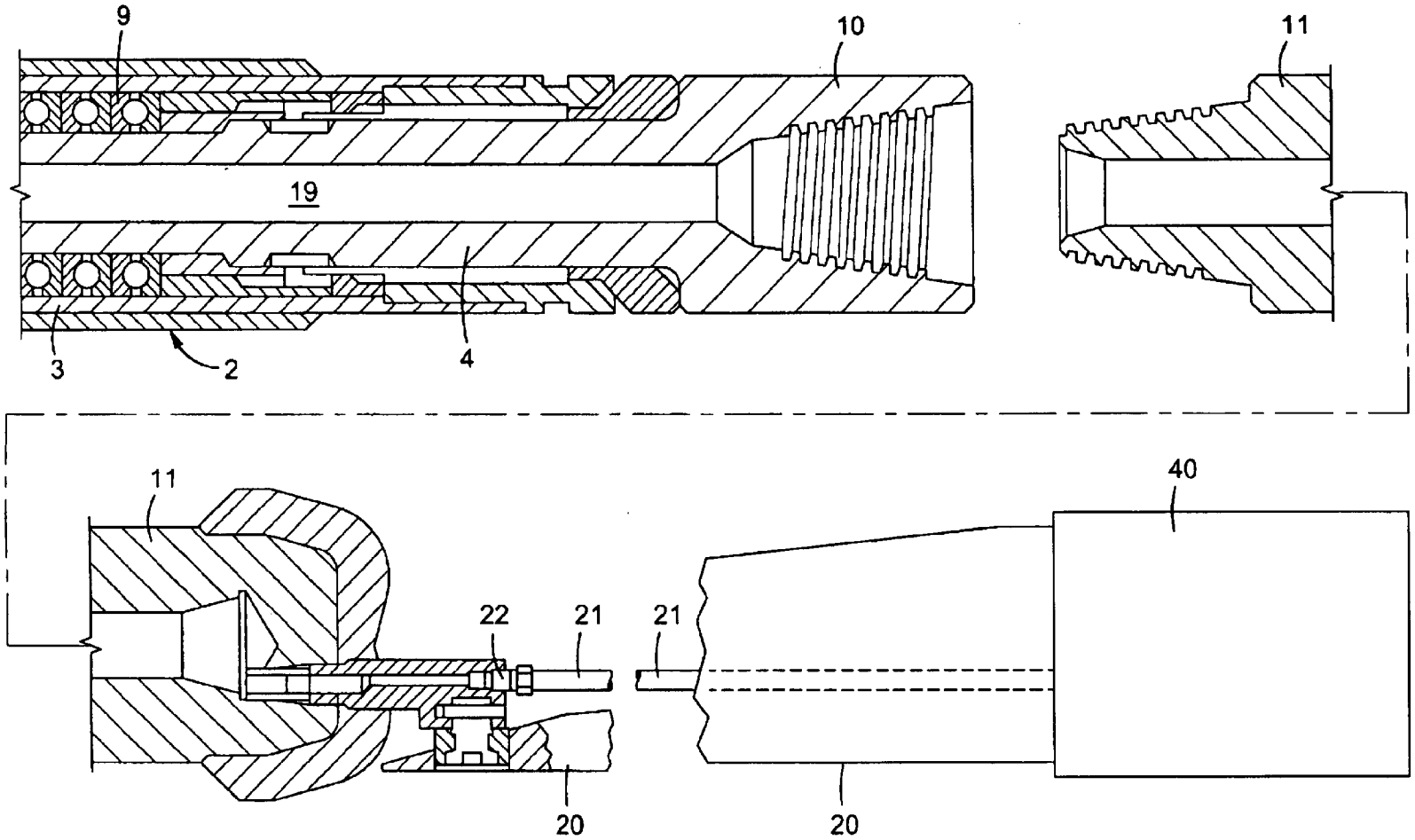
FIG. 7 is an exploded schematic view of the lower portion of the motor illustrated in FIGS. 1 and 6 and shows schematically a milling tool and the upper end of a whipstock for connection to the motor assembly.

In order to generate a force on the locking member 12 to shear the shear ring 23 an annular chamber 26 is designed between the sub 6 and the locking member 12. The annular chamber 26 is connected to the exterior of the tool by a passage 27 so that annulus pressure subsists in the annular chamber 26. A further annular chamber 28 is provided between the locking member 12 and the sub 5 and is connected to the longitudinal through passage 17 of the locking member by radial passage 29. The annular chamber 28 is defined between seals 30, 31 located on the locking member. Accordingly, if pressure within the through passage 17 of the locking member exceeds the pressure within the annulus surrounding the tool, a force will be generated on the locking member 12 tending to move it away from the motor 2. This force will be resisted by the shear ring 23 until the shear force of the shear ring is exceeded whereupon the locking member will move rapidly away from the motor until its movement is arrested by a pin 32 provided on the sub 6. This configuration of the components is illustrated in FIG. 6. It will be noted that the splined projection 13 of the locking member has moved clear of the splined recess 14 of the rotor, thereby freeing the rotor for rotation. Also, the through passage 17 of the locking member is now positioned to supply drilling fluid to the motor for operation thereof.

The fluid pressure necessary to shear the shear ring 23 may be generated by a hydrostatic pressure, for example by designing the shear ring so that the shear force required to shear it is substantially higher than the hydrostatic pressure required to set the packer. Under these circumstances, the tool may be run into the well, oriented as necessary, and fluid pressure applied to the tool to set the packer. Once the packer has been set and the set confirmed by applying a vertical load to the packer, fluid pressure is increased until a sufficient hydraulic force is generated on the locking member to shear the shear ring.

In order to control the amount of fluid flowing through passage 19 during operation of the motor, a nozzle 33 is preferably provided. The nozzle may be chosen to have an aperture 34 allowing fluid to flow through the nozzle to set the packer, but restricting the rate of flow of fluid once the rotor has been released and the motor is in operation.

Preferably, a ratchet ring 35 is provided for holding the locking member 12 in its second position, after it has moved into its second position upon shearing of the shear ring 23. The ratchet ring may be a single ring or may comprises a plurality of ratchet segments 36 held by means of spring clips 37 around a ratchet tooth area 38 provided on the locking member. Once the locking member has moved into the position illustrated in FIG. 6 it is unable to move downwardly so long as the ratchet ring 35 is in operation. Accordingly, there is no danger that vibration or fluid pressure or flow effects will cause the locking member to return to a position where it can engage the motor rotor.

It will be noted that once the motor assembly has been recovered it can readily be reset to the locked condition illustrated in FIG. 1. To achieve this, the sub 7 is separated from the sub 6 to permit the replacement of the shear ring 23 with a fresh shear ring. To facilitate assembly the shear ring is preferably split into two or more parts. The rotor is then manually rotated to align the projection 13 with the recess 14 and the locking member 12 is again engaged with the rotor. The sub 7 is then replaced and the motor assembly is ready for re-use.

What is claimed is:

1. A method for drilling a lateral well bore from a main well bore comprising:

running an assembly including an anchor, a whipstock, a cutting tool, and a motor into the main well bore;

orienting the whipstock without operating the motor;

setting the anchor while flowing a fluid through the motor without operating the motor; and operating the motor to rotate the cutting tool to cut a window through a casing in the main well bore.

2. The method of claim 1 further comprising continuing to drill the lateral well bore with the cutting tool.

3. The method of claim 2 wherein running the assembly, orienting the whipstock, setting the anchor, operating the motor to rotate the cutting tool to cut the window, and drilling the lateral well bore occurs in a single trip.

4. The method of claim 1 further comprising directionally drilling the lateral well bore with the cutting tool.

5. The method of claim 4 wherein running the assembly, orienting the whipstock, setting the anchor, operating the motor to rotate the cutting tool to cut the window, and directionally drilling the lateral well bore occurs in a single trip.

6. The method of claim 1 further comprising locking the motor in a rotationally stationary position to prevent the motor from operating.

7. The method of claim 6 further comprising selectively releasing the motor to an operable position.

8. The method of claim 7 further comprising maintaining the motor in the operable position.

9. The method of claim 7 wherein selectively releasing the motor comprises increasing pressure within the motor to a predetermined value.

10. The method of claim 7 further comprising re-locking the motor in the rotationally stationary position.

11. The method of claim 1 wherein running the assembly, orienting the whipstock, setting the anchor, and operating the motor to rotate the cutting tool to cut the window occurs in a single trip.

12. A method for drilling a lateral well bore from a main well bore comprising:

running an assembly including an anchor, a whipstock, a locked motor, and a cutting tool into the main well bore;

orienting the whipstock while the motor is locked;

setting the anchor while flowing a fluid through the motor when the motor is locked;

selectively unlocking the motor; and operating the motor to rotate the cutting tool to cut a window through a casing in the main well bore.

13. The method of claim 12 further comprising continuing to drill the lateral well bore with the cutting tool.

14. The method of claim 13 wherein running the assembly, orienting the whipstock, setting the anchor, selectively unlocking the motor, operating the motor to rotate the cutting tool to cut the window, and drilling the lateral well bore occurs in a single trip.

15. The method of claim 12 further comprising directionally drilling the lateral well bore with the cutting tool.

16. The method of claim 15 wherein running the assembly, orienting the whipstock, setting the anchor, selectively unlocking the motor, operating the motor to rotate the cutting tool to cut the window, and directionally drilling the lateral well bore occurs in a single trip.

17. The method of claim 12 further comprising maintaining the motor in the unlocked position.

18. The method of claim 12 wherein selectively unlocking the motor comprises increasing pressure within the motor to a predetermined value.

19. The method of claim 12 further comprising re-locking the motor.

20. The method of claim 12 wherein running the assembly, orienting the whipstock, setting the anchor, selectively unlocking the motor, and operating the motor to rotate the cutting tool to cut the window occurs in a single trip.

21. A method of drilling a window through a casing in a well bore extending into a formation comprising:

running an anchor, a whipstock, a motor, and a cutting tool into the well bore;

orienting the whipstock;

flowing a fluid through the motor at a first pressure sufficient to set the anchor without rotating the motor; and flowing a fluid through the motor at a second pressure sufficient to actuate the motor to rotate the cutting tool and cut the window.

22. The method of claim 21 further comprising flowing a fluid through the motor at a third pressure sufficient to release the motor from a locked position.

23. The method of claim 21 further comprising continuing to drill a lateral well bore into the formation with the cutting tool.

24. The method of claim 21 further comprising directionally drilling a lateral well bore into the formation with the cutting tool.

* * * * *

UNITED STATES PATENT AND TRADEMARK OFFICE

CERTIFICATE OF CORRECTION

PATENT NO. : 6,945,328 B2
DATED : September 20, 2005
INVENTOR(S) : Brian Cruickshank, et al.

It is certified that error appears in the above-identified patent and that said Letters Patent is hereby corrected as shown below:

Column 4,
Line 60, after "anchor" insert -- 40 --.
Line 67, after "packer" insert -- or anchor 40 located --.

Column 5,
Line 54, after "packer" insert -- or anchor 40 --.
Line 56, replace "pressure applied to the tool to set the packer." with -- pressure applied to the tool to set the packer or anchor 40. --.
Lines 56-60, replace the sentence "Once the packer has been set and the set confirmed by applying a vertical load to the packer, fluid pressure is increased until a sufficient hydraulic force is generated on the locking member to shear the shear ring." with -- Once the packer or anchor 40 has been set and the set confirmed by applying a vertical load to the packer or anchor 40, fluid pressure is increased until a sufficient hydraulic force is generated on the locking member to shear the shear ring. --.
Line 66, after "packer" insert -- or anchor 40 --.

Signed and Sealed this

Sixth Day of December, 2005

JON W. DUDAS
*Director of the United States Patent and Trademark Office*